US010760578B2

(12) United States Patent
Shiba

(10) Patent No.: US 10,760,578 B2
(45) Date of Patent: Sep. 1, 2020

(54) VACUUM PUMP WITH HEAT GENERATION ELEMENT IN RELATION TO HOUSING

(71) Applicant: SHIMADZU CORPORATION, Kyoto (JP)

(72) Inventor: Mamoru Shiba, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 136 days.

(21) Appl. No.: 16/166,131

(22) Filed: Oct. 21, 2018

(65) Prior Publication Data

US 2019/0120237 A1 Apr. 25, 2019

(30) Foreign Application Priority Data

Oct. 25, 2017 (JP) ..... 2017-206548

(51) Int. Cl.

| | |
|---|---|
| ***F04D 19/04*** | (2006.01) |
| ***F04D 25/06*** | (2006.01) |
| ***F04D 29/58*** | (2006.01) |
| ***F04D 29/049*** | (2006.01) |

(52) U.S. Cl.

CPC ..... *F04D 19/042* (2013.01); *F04D 19/044* (2013.01); *F04D 25/06* (2013.01); *F04D 25/068* (2013.01); *F04D 29/584* (2013.01); *F04D 29/5813* (2013.01); *F04D 29/5853* (2013.01); *F04D 29/049* (2013.01); *F05B 2260/221* (2013.01); *F05B 2260/231* (2013.01)

(58) Field of Classification Search

CPC ..... F04D 19/04–048; F04D 17/168; F04D 29/5853; F04D 29/5813; F04D 25/0693; F04D 25/068; F05B 2260/221; F05B 2260/231

See application file for complete search history.

(56) References Cited

U.S. PATENT DOCUMENTS 5,577,883 A * 11/1996 Schutz ..... F04D 19/04 415/90
5,940,576 A * 8/1999 de Simon ..... F04D 27/00 318/400.27

(Continued)

FOREIGN PATENT DOCUMENTS

GB 2553321 A * 3/2018 ..... F04D 29/5853
JP 2004183619 A * 7/2004 ..... F04D 25/0693

(Continued)

*Primary Examiner* — Michael Lebentritt
*Assistant Examiner* — Topaz L. Elliott
(74) *Attorney, Agent, or Firm* — Renner, Otto, Boisselle & Sklar, LLP

(57) ABSTRACT

A vacuum pump comprises: a pump device configured to rotate a rotor about a rotation axis supported by a ball bearing, thereby discharging gas sucked through a pump suction port from a pump exhaust port; and a control device attached to a side surface along a direction of the rotation axis of the pump device, including an electronic circuit having a heat generation element and a housing configured to house the electronic circuit, and configured to control operation of the pump device. The heat generation element directly contacts an outer plate of the housing not contacting the pump device, and does not contact an outer plate of the housing contacting the pump device.

9 Claims, 6 Drawing Sheets

(56) References Cited

U.S. PATENT DOCUMENTS

| | | | | | |
|---|---|---|---|---|---|
| 5,971,725 | A * | 10/1999 | de Simon | F04D 19/04 | 417/423.1 |
| 6,442,027 | B2 * | 8/2002 | Sanada | H05K 7/20854 | 361/704 |
| 9,267,392 | B2 * | 2/2016 | Schroder | F04D 25/068 | |
| 9,353,755 | B2 * | 5/2016 | Nagano | F04D 19/042 | |
| 9,534,506 | B2 * | 1/2017 | Okudera | F04D 25/0693 | |
| 9,890,796 | B2 * | 2/2018 | Moriyama | F04D 29/584 | |
| 10,215,191 | B2 * | 2/2019 | Omori | F04D 19/04 | |
| 2013/0209272 | A1 * | 8/2013 | Omori | F04D 29/5813 | 417/26 |
| 2015/0184665 | A1 * | 7/2015 | Yamato | F04D 29/58 | 415/47 |
| 2016/0195098 | A1 * | 7/2016 | Omori | H02K 11/33 | 417/423.7 |
| 2017/0227018 | A1 * | 8/2017 | Moriyama | F04D 29/584 | |
| 2018/0254685 | A1 * | 9/2018 | Seki | F04C 15/008 | |
| 2019/0277296 | A1 * | 9/2019 | Okada | F04D 19/04 | |
| 2019/0309760 | A1 * | 10/2019 | Omori | F04D 19/04 | |

FOREIGN PATENT DOCUMENTS

| | | | | | |
|---|---|---|---|---|---|
| JP | 2006090251 | A * | 4/2006 | F04D 29/5813 | |
| JP | 2006342686 | A * | 12/2006 | F04D 25/068 | |
| JP | 2014105695 | A | 6/2014 | | |
| WO | WO-2007013274 | A1 * | 2/2007 | F04D 19/042 | |
| WO | WO-2019159854 | A1 * | 8/2019 | F04B 39/00 | |
| WO | WO-2019159855 | A1 * | 8/2019 | F04B 37/16 | |

* cited by examiner

VACUUM PUMP WITH HEAT GENERATION ELEMENT IN RELATION TO HOUSING

BACKGROUND OF THE INVENTION

1. Technical Field

The present invention relates to an integrated vacuum pump configured such that a pump device and a control device are integrated.

2. Background Art

A turbo-molecular pump has been used as a vacuum pump used for a semiconductor manufacturing device, an analysis device, etc. The turbo-molecular pump includes a pump device and a control device having a drive circuit, a control circuit, etc. for driving and controlling a motor etc. in the pump device.

In the turbo-molecular pump, a rotor provided with multiple stages of rotor blades is rotated at high speed for air discharging, and therefore, a bearing configured to rotatably support a shaft as a rotary shaft of the rotor in the vicinity of each end of the shaft is provided. A grease lubrication type ball bearing or a magnetic bearing utilizing attractive repulsion of a permanent magnet or an electromagnet is used as the bearing. The magnetic bearing has an advantage that is contactless, but is larger and needs a higher cost as compared to the ball bearing. For this reason, in a compact pump, the magnetic bearing is used at one suction port side (high vacuum side) end portion of the shaft, but the compact low-cost grease lubrication type ball bearing is generally used at the other exhaust port side (low vacuum side) end portion.

For reducing the size of the turbo-molecular pump, integration of a pump device and a control device as described in Patent Literature 1 (JP-A-2014-105695) has been known. In a turbo-molecular pump described in Patent Literature 1, a recessed portion is formed at a side surface of a base of the pump device configured to perform vacuum pumping, and the control device including a board on which an electronic component is mounted is housed in the recessed portion. In this manner, the size is reduced.

In the turbo-molecular pump, driving with high power is necessary for rotating the rotor at high speed, and for this reason, the drive circuit in the control device is specifically a great heat generation source. In the case of integrating the pump device and the control device for size reduction, heat generated at a heat generation element such as the drive circuit in the control device is transmitted to the pump device. This leads to a problem that when such heat is transmitted to the ball bearing supporting the rotor, a lubricant of the ball bearing such as grease is heated and evaporated and the life of the ball bearing is shortened.

SUMMARY OF THE INVENTION

A vacuum pump comprises: a pump device configured to rotate a rotor about a rotation axis supported by a ball bearing, thereby discharging gas sucked through a pump suction port from a pump exhaust port; and a control device attached to a side surface along a direction of the rotation axis of the pump device, including an electronic circuit having a heat generation element and a housing configured to house the electronic circuit, and configured to control operation of the pump device. The heat generation element directly contacts an outer plate of the housing not contacting the pump device, and does not contact an outer plate of the housing contacting the pump device.

The housing is a substantially rectangular parallelepiped body having a longitudinal direction along the direction of the rotation axis, and the outer plate of the housing contacting the heat generation element is an outer plate extending along the direction of the rotation axis.

The housing contacts the pump device via a heat insulating member.

The vacuum pump further comprises: a cooling fan placed on an outer surface of the pump device and configured to cool the pump device.

The control device is placed on a cooling path of cooling wind from the cooling fan.

The cooling fan is placed on a side of the pump device opposite to the control device with respect to the rotation axis.

The heat generation element is connected to the outer plate of the housing via a heat transfer member.

a portion of a side surface of the pump device facing the control device is a flat surface, and a clearance between the flat surface and the control device is provided.

The outer plate of the housing which the heat generation element directly contacts is made of metal.

The outer plates are joined with each other via a high thermal resistive seal material.

According to the present invention, heat generated from a heat generation element in a control device is released from a housing of the control device to the outside. Consequently, an increase in the temperature of a ball bearing can be prevented.

DETAILED DESCRIPTION OF THE EXEMPLARY EMBODIMENTS

First Embodiment

Figure 1:
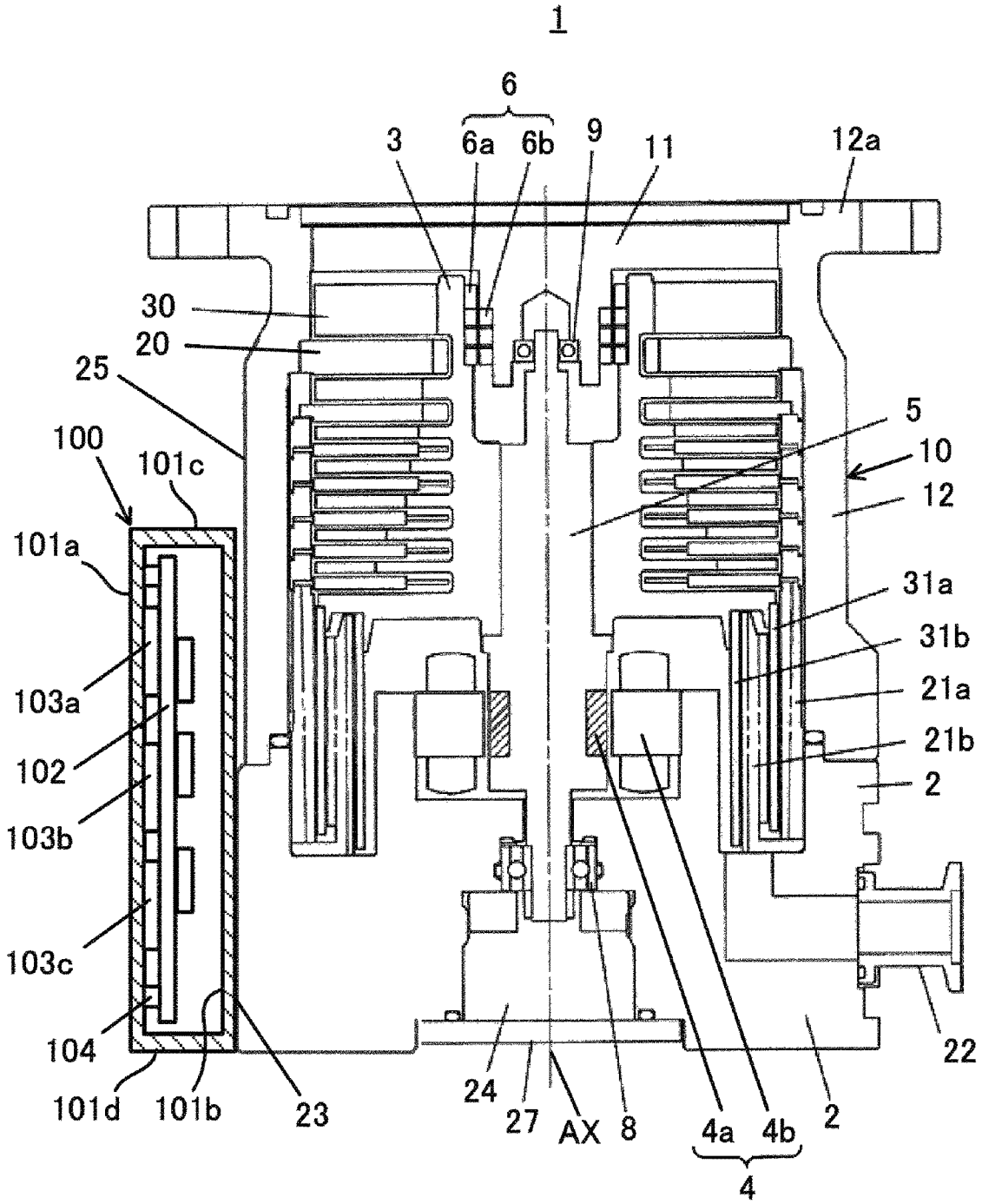
FIG. 1 is a sectional view of a turbo-molecular pump 1 of a first embodiment.

Hereinafter, a first embodiment of the present invention will be described with reference to the drawings. FIG. 1 is a sectional view of a vacuum pump of the first embodiment of the present invention.

A turbo-molecular pump 1 has a pump device 10 configured to perform vacuum pumping, and a control device 100 configured to drive the pump device 10. An attachment surface 23 is formed at a side surface of a base 2 of the pump device 10, and the control device 100 is attached to the attachment surface 23 with bolts.

A structure of the pump device 10 will be described. The pump device 10 includes, as exhaust functional portions, a turbo pump portion having turbine blades, and a Holweck pump portion having a spiral groove.

The turbo pump portion includes multiple stages of rotor blades 30 formed at a rotor 3, and multiple stages of stationary blades 20 arranged on a pump case 12 side. On the other hand, the Holweck pump portion provided on a downstream side of the turbo pump portion includes a pair of cylindrical portions 31*a*, 31*b* formed at the rotor 3, and a pair of stators 21*a*, 21*b* arranged on a base 2 side. Of inner and outer peripheral surfaces of the cylindrical stators 21*a*, 21*b*, peripheral surfaces facing the cylindrical portions 31*a*, 31*b* are provided with the spiral groove. Note that instead of providing the spiral groove on a stator side, the spiral groove may be provided on a rotor side.

The rotor 3 is fastened to a shaft 5, and the rotor 3 and the shaft 5 form an integrated rotary body. The shaft 5 is rotatably driven by a motor 4. A motor rotor 4*a* is provided at the shaft 5, and a motor stator 4*b* is fixed to the base 2. A lower end side of the shaft 5 is held by a ball bearing 8 in which grease is sealed. On the other hand, an upper end side of the shaft 5 is non-contact supported by a permanent magnet magnetic bearing 6 using permanent magnets 6*a*, 6*b*. By these upper and lower bearings, the shaft 5 and the rotor are rotatably supported about a rotation axis AX of the rotor.

The vacuum pump of the present example has a touch-down bearing configured to limit runout of a shaft upper portion in a radial direction, such as a ball bearing 9. The ball bearing 9 is housed in a magnet holder 11. That is, in a steady rotation state of the rotor 3, the shaft 5 and the ball bearing 9 do not contact each other. Note that in the case of applying great disturbance or great whirling of the rotor 3 upon acceleration or deceleration of rotation, the shaft 5 comes into contact with an inner ring of the ball bearing 9. For example, deep groove ball bearings are used as the ball bearings 8, 9.

A base cover 27 configured to seal an opening 24 upon attachment/detachment of the ball bearing 8 is bolted to a bottom surface of the base 2. At a pump case 12, a suction port flange 12*a* configured to fix the pump device 10 to, e.g., a chamber is formed. Moreover, an exhaust port 22 is provided at a side surface of the base 2. Gas molecules having flowed in through the suction port flange 12*a* are transferred to the pump downstream side by the turbo pump portion and the Holweck pump portion, and then, are discharged through the exhaust port 22.

Next, the control device 100 will be described with reference to FIGS. 1 and 2.

Figure 2:
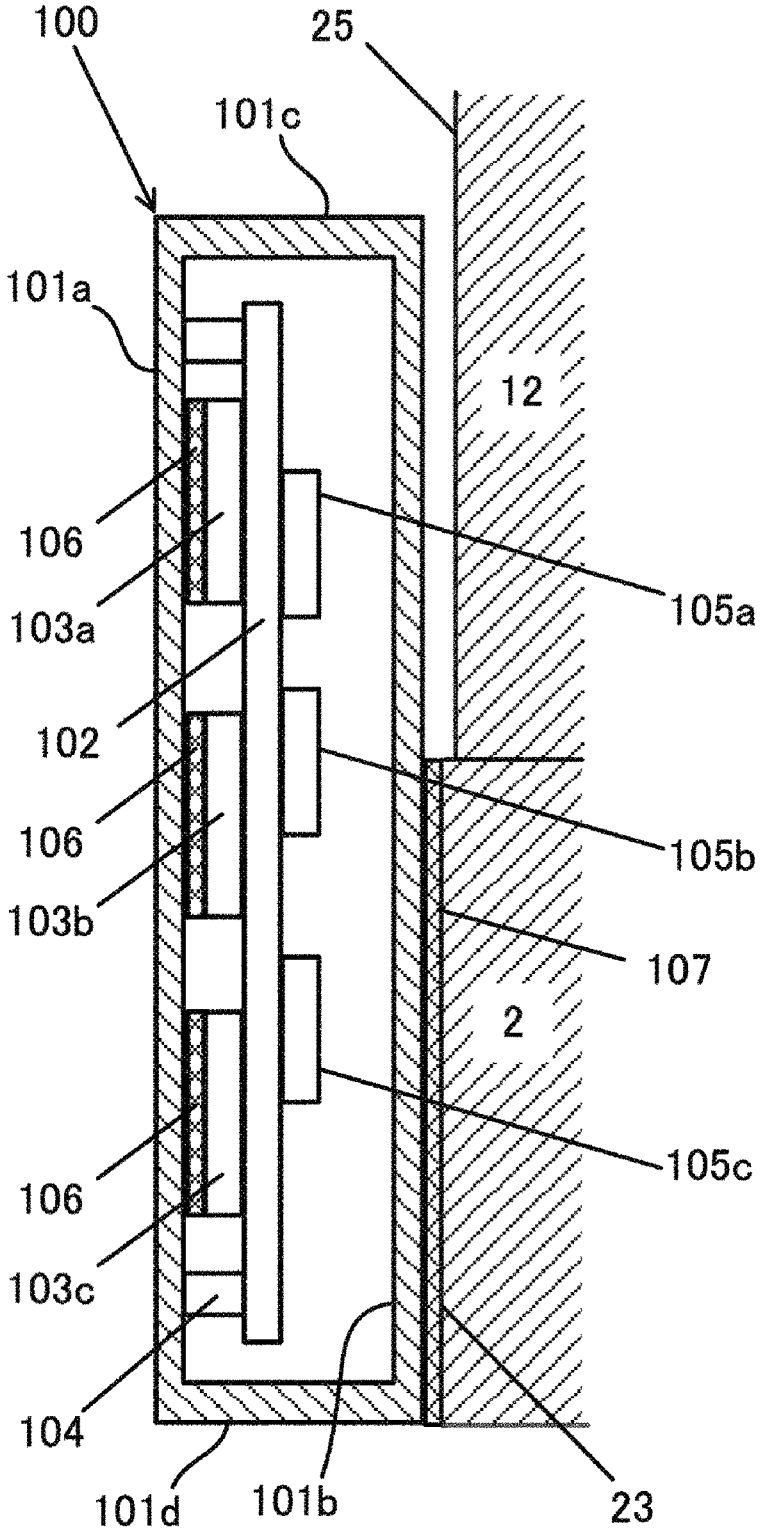
FIG. 2 is a sectional view of a control device 100.

FIG. 2 is an enlarged sectional view of the control device 100 illustrated in the sectional view of FIG. 1. The control device 100 includes an electronic circuit having a power semiconductor element configured to drive the motor 4 in the pump device 10, a circuit board 102, etc., and a housing 101 configured to house the electronic circuit. The outer shape of the housing 101 is a substantially rectangular parallelepiped shape, but is not limited to such a shape. The outer shape of the housing 101 may be any shape. Of six outer plates forming such a rectangular parallelepiped shape, the sections of four outer plates 101*a*, 101*b*, 101*c*, 101*d* are illustrated in FIGS. 1 and 2 as the sectional views. The housing 101 indicates the entirety of these six outer plates 101*a* to 101*d* and a not-shown member coupling these plates.

The outer plates 101*a*, 101*b* of the housing 101 are members extending in a longitudinal direction, and extend in an upper-to-lower direction in FIGS. 1 and 2. In other words, the control device 100 is attached to the side surface (the attachment surface 23) of the base 2 of the vacuum pump 1 such that the longitudinal direction of the outer plate 101*b* is coincident with a rotation axis of the motor 4, i.e., the rotation axis AX of the shaft 5. Thus, the outer plate 101*a* facing to the outer plate 101*b* faces the outside of the vacuum pump, and extends in the direction of the rotation axis AX.

The control device 100 is attached to the pump device 10 in such a manner that a lower portion of the outer plate 101*b* of the housing 101 is attached to the attachment surface 23 of the base 2 with bolts. A not-shown power application connector is placed at part of a portion between the outer plate 101*b* and the attachment surface 23, and therefore, a control signal or drive power from the control device 100 is transmitted to, e.g., the motor 4 in the pump device 10.

The circuit board 102 is, by screwing etc., fixed to the outer plate 101*a* on the opposite side of the outer plate 101*b* via a support rod 104. On each surface of the circuit board 102, printed wiring is formed, and various types of electronic components are mounted. Note that elements (these elements will be hereinafter also collectively referred to as "heat generation elements 103") with a great heat generation amount upon operation, such as an inverter element 103*a* configured to output a PWM drive signal to the motor 4, a driver element 103*b* configured to drive the inverter element 103*a*, and a backflow prevention diode element 103*c*, are arranged on a surface of the circuit board 102 opposite to the outer plate 101*b*. These heat generation elements directly contact the metal outer plate 101*a* opposite to the outer plate 101*b* of the housing 101. The phrasing "directly contact" means that the heat generation elements 103 are connected to the outer plate 101*a* without the circuit board 102. Preferably, the heat generation elements 103 directly contact the outer plate 101*a* via a high thermal conductive heat transfer sheet 106.

The heat generation elements 103 are connected to the outer plate 101*a* of the housing 101 with low thermal resistance. Accordingly, heat generated at the heat generation elements 103 is transmitted to the metal outer plate 101*a* with a high efficiency, and is released from the outer plate 101*a*. On the other hand, neither of the circuit board 102 nor the heat generation elements 103 is connected to the outer plate 101*b* connected to the base 2. This can prevent or suppress the heat from the heat generation elements 103 from transmitting to the base 2 via the outer plate 101*b*. Thus, an increase in the temperature of the ball bearing 8 in the pump device 10 can be prevented, and evaporation of the grease can be prevented or reduced.

On the other hand, elements with a relatively small heat generation amount upon operation, such as a CPU 105*a*, a control IC 105*b*, and a storage element 105*c*, do not need to be cooled much with a high efficiency. Thus, as in FIG. 2, these elements may be arranged on an outer plate 101*b* side of the circuit board 102. Heat generated at these elements is transmitted to the outer plate 101*a* by way of the circuit board 102 and the support rod 104, and then, is released from the outer plate 101*a*.

Note that for promoting heat release via the circuit board 102, the circuit board 102 may contact, with low thermal resistance, the upper outer plate 101*c*, the lower outer plate 101*d*, or a not-shown near-side or far-side outer plate of the control device 100 via a low thermal resistor (a high thermal conductor) such as a graphite sheet.

Connection among the heat generation elements 103 and the outer plate 101*a* is not limited to contact via the heat transfer sheet 106, and can be also low thermal resistance connection via a low thermal resistor (a high thermal conductor) such as a graphite sheet.

The outer plates for contact of the heat generation elements with low thermal resistance are not limited to above, and contact with any outer plate of the housing 101 may be made as long as the outer plate is other outer plates than the outer plate 101*b* contacting the base 2. Note that contact with the outer plate far from the outer plate 101*b* as much as possible is preferable considering thermal conductivity by the housing 101 itself.

In arrangement of each heat generation element 103 on the circuit board 102, the element with the greatest heat generation amount preferably contacts the outer plate at a position far from a contact portion between the outer plate 101*b* and the base 2 as much as possible. Thus, in the present example, the inverter element 103*a* as the element with the greatest heat generation amount among the heat generation elements 103 contacts an upper portion of the outer plate 101*a* at a position farthest from the lower portion of the outer plate 101*b* contacting the base 2 among the outer plates of the housing 101.

A portion of a side surface of the pump case 12 of the pump device 10 facing the control device 100 is a flat surface 25. With a clearance between the flat surface 25 and the control device 100, thermal conduction from the inverter element 103*a* to the pump device 10 is further reduced.

In description above, the control device 100 includes the single circuit board 102, but may include two or more circuit boards 102. In this case, the heat generation elements 103 are arranged on the opposite side of the outer plate 101*b* on the circuit board 102 far from the outer plate 101*b* contacting the base 2, and are connected to other outer plates (e.g., the outer plate 101*a*) than the outer plate 101*b* with low thermal resistance.

Note that the housing 101 may be configured such that the outer plates 101*a* to 101*d* are directly joined to each other, but may be configured such that the outer plates 101*a* to 101*d* may be joined via a high thermal resistive seal material such as rubber or a resin material. In the latter case, thermal conduction from the outer plate contacting the heat generation element to the outer plate 101*b* contacting the base 2 can be further reduced.

In FIG. 1, the control device 100 is arranged on the opposite side of a pump main body from the exhaust port 22, but a positional relationship between the control device 100 and the exhaust port 22 is not limited to above. For example, the control device 100 and the exhaust port 22 may be at positions apart from each other at 90 degrees about the axial center (the rotation axis AX) of the pump device 10, or may be arranged at other optional positions as long as the control device 100 and the exhaust port 22 do not mechanically overlap with each other.

Moreover, the present invention is not limited to the vacuum pump including, as the exhaust functional portions, the turbo pump portion and the Holweck pump portion, and may be also applied to a vacuum pump including only turbine blades, a vacuum pump including only a drag pump such as a Siegbahn pump or a Holweck pump, or a vacuum pump with a combination thereof.

Advantageous Effects of First Embodiment

The vacuum pump 1 of the first embodiment of the present invention includes the pump device 10 configured to rotate the rotor 3 at high speed about the rotation axis AX supported by the ball bearing 8, and the control device 100 configured to control operation of the pump device 10. The heat generation elements 103 in the control device 100 directly contact the outer plate 101*a* of the housing 101 of the control device 100 not contacting the pump device 10. The heat generation elements 103 do not contact the outer plate 101*b* contacting the pump device 10.

With this configuration, the heat generated at the heat generation elements 103 is transmitted to the outer plate 101*a* with a high efficiency, and then, is released from the outer plate 101*a*. This provides the effect of preventing or suppressing the heat from the heat generation elements from transmitting to the base 2 via the outer plate 101*b* and preventing or suppressing an increase in the temperature of the ball bearing 8 in the pump device 10. As a result, lowering of the degree of vacuum of a vacuum device due to heating and evaporation of the grease of the ball bearing can be prevented or suppressed. Further, a decrease in the grease can be prevented or suppressed. Consequently, the life of the ball bearing and therefore the life (the maintenance cycle) of the vacuum pump can be extended.

Note that in the above-described first embodiment, the longitudinal direction of the outer plates 101*a*, 101*b* of the housing 101 extends in the direction of the rotation axis AX of the shaft 5, i.e., the upper-to-lower direction in FIGS. 1 and 2, but the shape of the housing 101 is not limited to above.

Note that the shape of the vacuum pump 1 is generally elongated in the direction along the rotation axis AX. Thus, when the housing 101 extends in the direction of the rotation axis AX, the effect of expanding the area of the outer plate 101*a* without an increase in the size of the entirety of the vacuum pump 1 and releasing the heat from the heat generation elements 103 with a higher efficiency can be provided.

(First Variation)

Although not described above in the first embodiment, a heat insulating member 107 made of, e.g., rubber or a resin material can be also provided between the outer plate 101*b* of the housing 101 and the attachment surface 23 of the base 2 as illustrated in FIG. 2.

(Advantageous Effects of First Variation)

In this case, the housing 101 contacts the pump device 10 via the heat insulating member, and therefore, the effect of further reducing thermal conduction from the heat generation elements in the control device 100 to the pump device 10 is provided.

Second Embodiment

Figure 3:
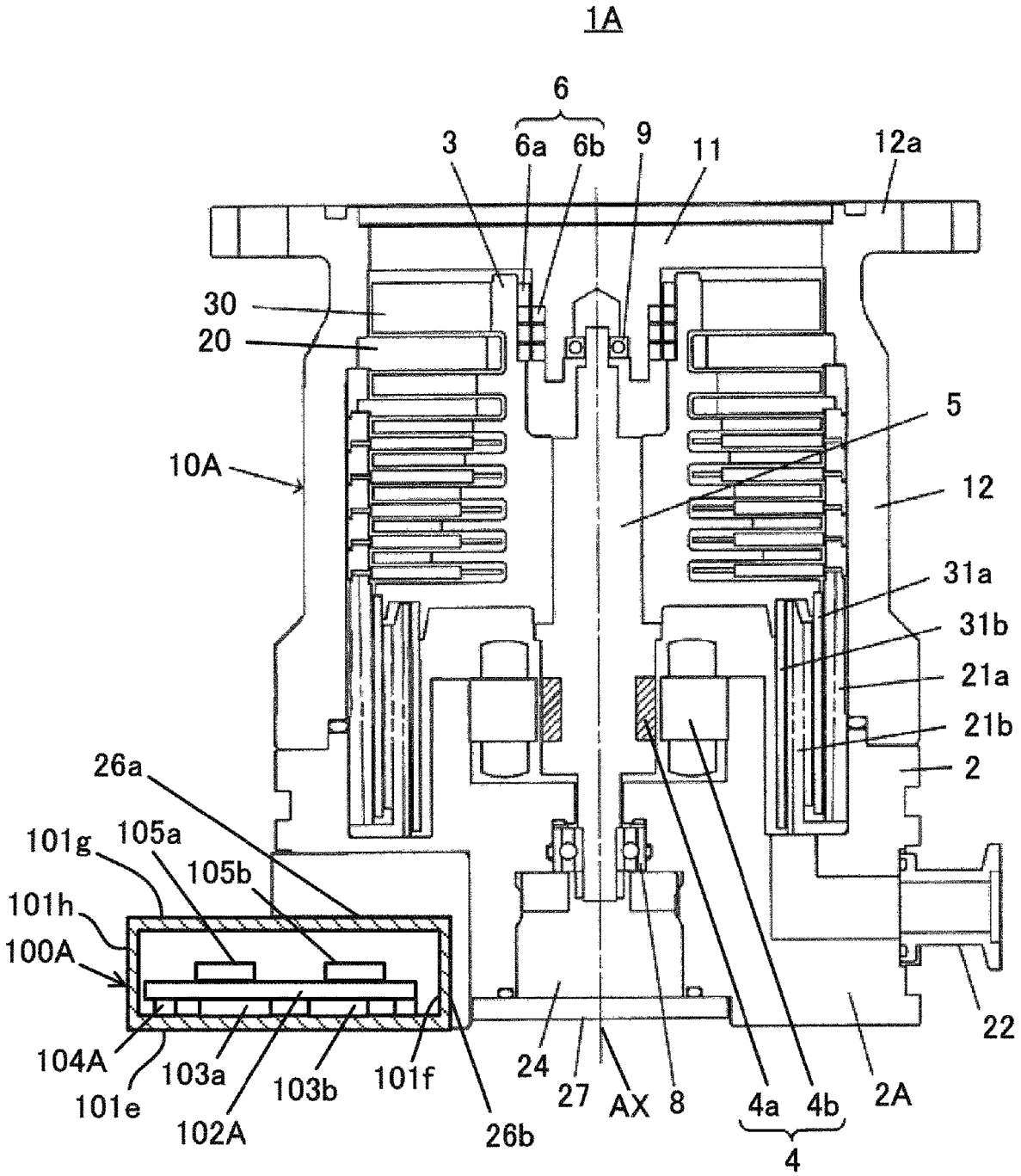
FIG. 3 is a sectional view of a turbo-molecular pump 1A of a second embodiment.

Hereinafter, a second embodiment of the present invention will be described with reference to FIG. 3. FIG. 3 is a sectional view of a vacuum pump of the second embodiment of the present invention. Note that elements with the same reference numerals as those of FIG. 1 are common to those of the first embodiment, and therefore, description thereof will be omitted.

In the second embodiment, a control device 100A is arranged in a recessed portion 26 formed in such a manner that part of the periphery of a lower portion of a base 2A at a side surface of a pump device 10A along the direction of a rotation axis AX is cut out. That is, the arrangement position of the control device 100A is the same as that in a vacuum pump disclosed in JP-A-2014-105695.

A boundary of the recessed portion 26 includes a recessed portion bottom surface 26*a* parallel with a pump bottom surface and a suction port flange surface, and a recessed portion side surface 26*b* perpendicular to the recessed portion bottom surface 26*a*.

In the present embodiment, the outer shape of the control device 100A, i.e., the outer shape of a housing 1012, is a substantially rectangular parallelepiped shape. Of six outer plates forming such a rectangular parallelepiped shape, the sections of four outer plates 101*e*, 101*f*, 101*g*, 101*h* are illustrated in FIG. 3 as the sectional view. The housing 1012 indicates the entirety of these six outer plates 101*e* to 101*h* and a not-shown member coupling these plates.

The control device 100A is attached to the pump device 10A in such a manner that an upper portion of the outer plate 101*g* and an outer portion of the outer plate 101*f* in the housing 1012 are each attached to the recessed portion bottom surface 26*a* and the recessed portion side surface 26*b* of the recessed portion 26 of the base 2A with bolts. Moreover, a not-shown power application connector is placed at part of a portion between the outer plate 101*f* and the recessed portion side surface 26*b*, and therefore, a control signal or drive power from the control device 100A is transmitted to, e.g., a motor 4 in the pump device 10A.

A circuit board 102A is fixed to the outer plate 101*e* not contacting the pump device 10A by screwing etc. via a support rod 104A, the outer plate 101*e* being different from the outer plate 101*g* and the outer plate 101*f* contacting the base 2A. In the present example, heat generation elements 103 such as an inverter element 103*a* and a driver element 103*b* are also arranged on an outer plate 101*e* side of the circuit board 102A. Moreover, these heat generation elements 103 contacts the metal outer plate 101*e* via a not-shown high thermal conductive heat transfer sheet.

On the other hand, elements with relatively small heat generation upon operation, such as a CPU 105*a* and a control IC 105*b*, do not need to be cooled much with a high efficiency, and for this reason, may be arranged on an outer plate 101*g* side of the circuit board 102A. Heat generated at these elements is transmitted to the outer plate 101*e* by way of the circuit board 102A and the support rod 104A, and then, is released from the outer plate 101*e*.

As in the above-described first embodiment, for further promoting heat release, the circuit board 102A may contact, with low thermal resistance, the left outer plate 101*h* of the control device 100A as viewed in the figure or a not-shown near-side or far-side outer plate of the control device 100A via a low thermal resistor.

Moreover, the heat generation elements 103 may contact the outer plate 101*h* with low thermal resistance via a low thermal resistor (a high thermal conductor) such as a graphite sheet.

In the present example, the inverter element 103*a* as the element with the greatest heat generation amount contacts a left (a side far from the base 2A) portion of the outer plate 101*e* as viewed in FIG. 3 at a position farthest from a portion contacting the base 2A among the outer plates of the housing 101Z.

Advantageous Effects of Second Embodiment

As in the above-described first embodiment, a vacuum pump 1A of the second embodiment as described above includes the pump device 10A configured to rotate a rotor 3 at high speed about the rotation axis AX supported by a ball bearing 8, and the control device 100A configured to control operation of the pump device 10A. The heat generation elements 103 in the control device 100A is, with low thermal resistance, connected to the outer plate 101*e* of the housing 101Z of the control device 100A not contacting the pump device 10A.

With this configuration, the heat generated at the heat generation elements 103 is transmitted to the outer plate 101*e* with a high efficiency, and then, is released from the outer plate 101*e*. This provides the effect of preventing the heat from the heat generation elements 103 from transmitting to the base 2A via the outer plates 101*g*, 101*f* and preventing an increase in the temperature of the ball bearing 8 in the pump device 10A.

Third Embodiment

Figure 4:
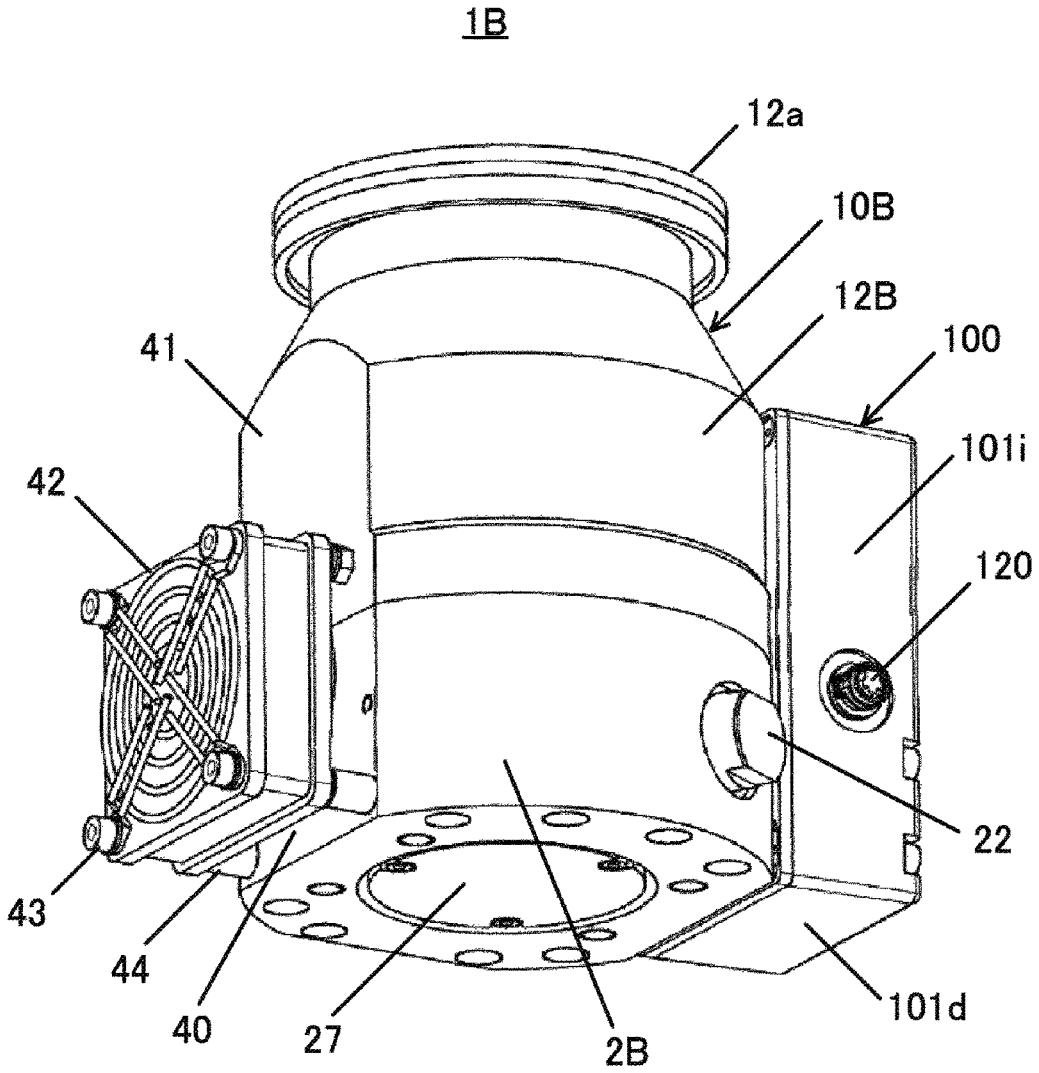
FIG. 4 is a perspective view of a turbo-molecular pump 1B of a third embodiment.

A third embodiment will be described with reference to FIGS. 4 and 5. FIG. 4 is a perspective view of a vacuum pump 1B of the third embodiment when the vacuum pump 1B is viewed diagonally from below.

A connector 120 provided at a control device 100 is a connector configured to connect, e.g., an electric wire for supplying power to a cooling fan.

In the present embodiment, a cooling fan 42 is basically provided on a side surface of a vacuum pump device 10B opposite to the control device 100 in the vacuum pump 1 of the above-described first embodiment.

Note that as illustrated in FIG. 4, a flat surface 40 and a flat surface 41 for attachment of the cooling fan 42 are each formed at side surfaces of a base 2B and a pump case 12B in the vacuum pump device 10B of the present embodiment.

The cooling fan 42 is, with bolts 43, fixed to the flat surfaces 40, 41 via support rods 44 for forming a clearance allowing passage of wind from the cooling fan 42. Hereinafter, a cooling path of cooling wind blowing from the cooling fan 42 will be described with reference to FIG. 5.

Figure 5:
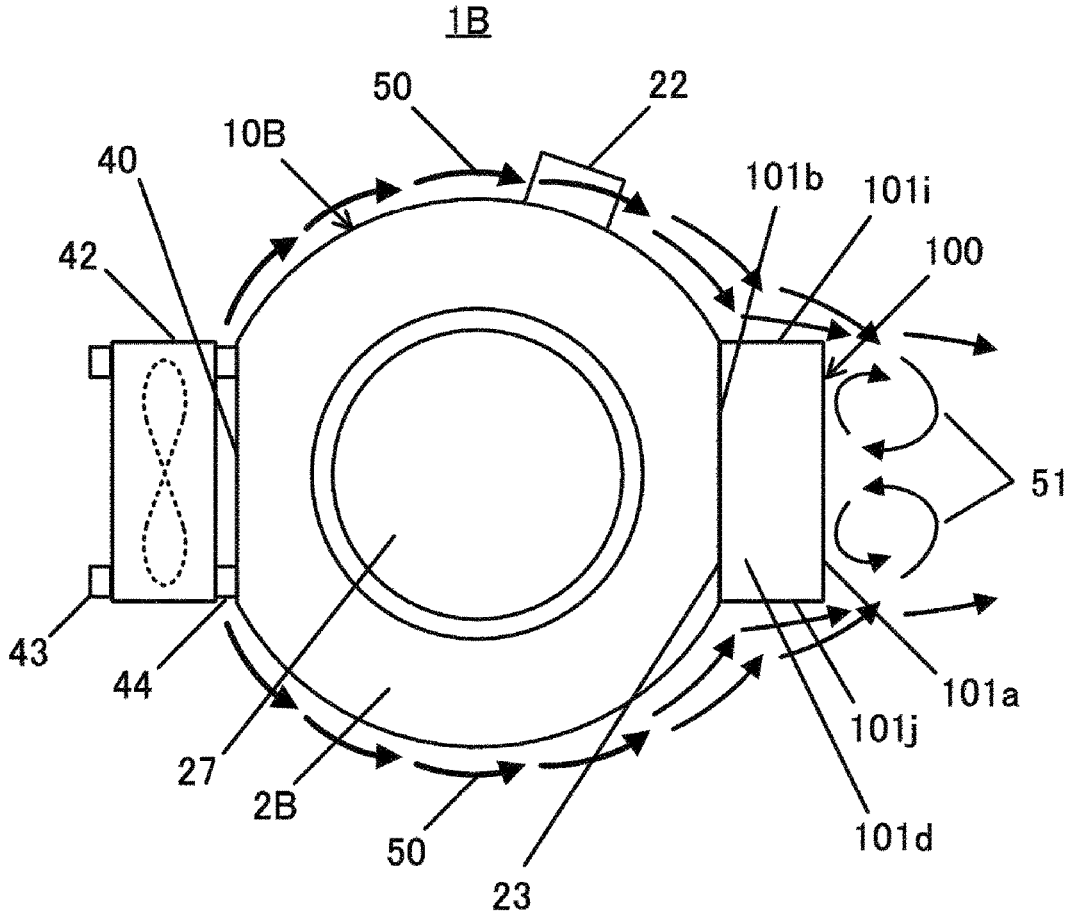
FIG. 5 is a bottom view of the turbo-molecular pump 1B of the third embodiment.

FIG. 5 is a plan view when the vacuum pump 1B of FIG. 4 is viewed from below. Cooling wind 50 having blown from the cooling fan 42 blows to both sides (the upper and lower sides in FIG. 5) of the base 2B through the clearance formed between the cooling fan 42 and the base 2B by the support rods 44.

The cooling wind 50 flows along the side surface of the base 2B to cool the base 2B. Then, in association with cooling of the base 2B, a ball bearing 8 provided in the base 2B is also cooled.

Thereafter, the cooling wind 50 flows along the side surface of the base 2B, and the cooling wind flowing on the upper side of the base 2B in FIG. 5 branches into the far and near sides in the plane of paper of FIG. 5 to pass through an exhaust port 22. Then, the cooling wind 50 reaches the control device 100 arranged on the opposite side of the base 2B from the cooling fan 42, thereby cooling outer plates 101*i*, 101*j* at side surfaces of a housing 101 of the control device 100.

Thus, in the present embodiment, heat generation elements 103 in the control device 100 are, with low thermal resistance, connected to the outer plate 101*i*, 101*j* at the side surfaces, and therefore, the effect of cooling the heat generation elements 103 can be further enhanced.

Note that the cooling wind 50 forms eddies 51 after having passed through the control device 100, and therefore, an outer plate 101*a* on the side of the housing 101 opposite to the base 2B is also cooled by the eddies 51. Thus, the heat generation elements 103 may be, with low thermal resistance, connected to the outer plate 101*a*.

Note that a radiation fin extending in a circumferential direction, i.e., formed parallel with a flow path of the cooling wind 50, may be formed on an outer peripheral surface of the base 2B to further improve a cooling efficiency.

Alternatively, radiation fins formed parallel with the flow path of the cooling wind 50 may be also formed on the outer plates 101*i*, 101*j* at the side surfaces of the housing 101 to further improve the cooling efficiency.

Note that part of a clearance between the cooling fan 42 and the base 2B may be covered with, e.g., a metal wind shielding plate. In this manner, a blowing direction of the cooling wind 50 from the cooling fan 42 can be limited, and the base 2B and the control device 100 can be much more efficiently cooled.

For example, a clearance (a lower clearance in FIG. 4) near a lower portion of the base 2B is covered so that the cooling wind 50 can be concentrated toward a peripheral surface of the base 2B, the control device 100, and the flat surface 41 of the pump case 12B. Further, an upper clearance in FIG. 4 is also covered so that the cooling wind can be concentrated toward the peripheral surface of the base 2B and the control device 100.

Advantageous Effects of Third Embodiment

As described above, the vacuum pump of the third embodiment is placed on an outer surface of the pump device 10B, and has the cooling fan 42 configured to cool the vacuum pump device 10B.

With such a configuration, the effect of efficiently cooling the vacuum pump device 10B and preventing an increase in the temperature of the ball bearing 8 in the vacuum pump device 10B is provided.

Moreover, it is configured such that the control device 100 is placed on the cooling path of the cooling wind 50 from the cooling fan 42, and therefore, the effect of cooling the control device 100 by the cooling fan 42 is provided.

Further, it is configured such that the cooling fan 42 is placed on the side of the vacuum pump device 10B opposite to the control device 100 with respect to the axial center of the vacuum pump device 10B, i.e., a rotation axis AX of a rotor 3. This provides the effect of cooling the control device 100 by means of both of the cooling paths of the cooling wind 50 divided in half by the vacuum pump device 10B.

Fourth Embodiment

Figure 6:
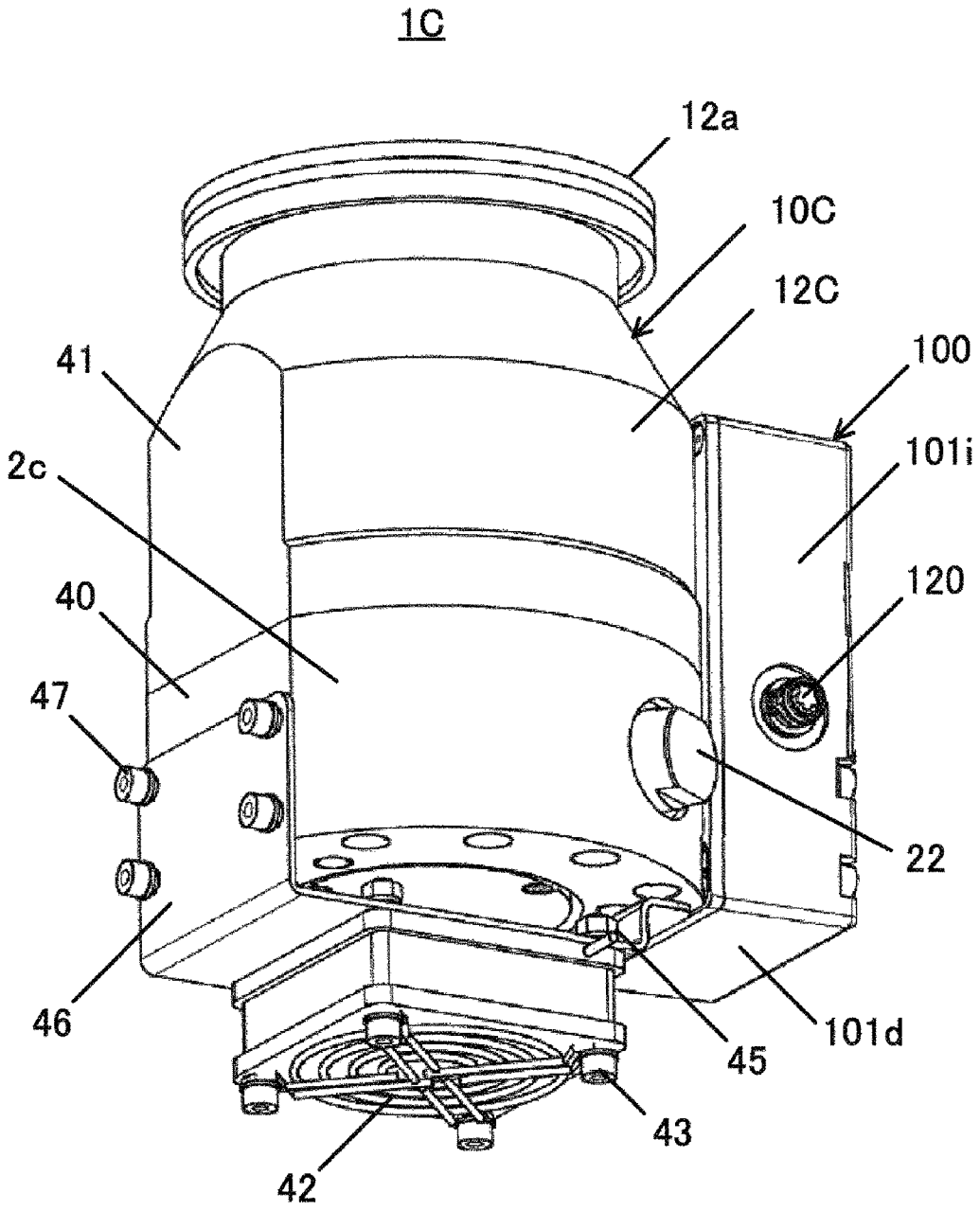
FIG. 6 is a perspective view of a turbo-molecular pump 1C of a fourth embodiment.

A fourth embodiment will be described with reference to FIG. 6. FIG. 6 is a perspective view of a vacuum pump 1C of the fourth embodiment when the vacuum pump 1C is viewed diagonally from below.

As in the above-described third embodiment illustrated in FIG. 4, a cooling fan 42 is basically provided at the vacuum pump 1 of the first embodiment in the present embodiment. Thus, the same reference numerals are used to represent common elements, and description thereof will be omitted.

Unlike the third embodiment, the cooling fan 42 is placed on a lower side of a base 2C of the vacuum pump 1C.

As described above, a base cover 27 configured to seal an opening 24 for attachment/detachment of a ball bearing 8 is present on the lower side (a bottom surface) of the base 2C, and for this reason, it is difficult to directly attach the cooling fan 42 to such a portion. Thus, the cooling fan 42 is, with bolts 43 and nuts 45, attached to an attachment seat 46 formed by deformation of a metal plate into a substantially L-shape, and the attachment seat 46 is attached to a flat surface 40 of a side surface of the base 2C with bolts 47.

Advantageous Effects of Fourth Embodiment

As described above, the vacuum pump of the fourth embodiment is placed on an outer surface of a pump device 10C, and has the cooling fan 42 configured to cool the pump device 10C.

With this configuration, the effect of efficiently cooling the pump device 10C and preventing an increase in the temperature of the ball bearing 8 in the pump device 10C is provided.

(Second Variation)

In the above-described third and fourth embodiments, the air cooling type cooling fan 42 is used for cooling the pump device 10 and the control device 100 of the first embodiment, but instead or in addition, a liquid cooling type cooling mechanism is provided. That is, a pipe is placed inside or at the periphery of the base 2 or the pump case 12 of the pump device 10, and cooling is performed by a coolant flow.

Further, a cooling pipe may be also provided at the periphery of the control device 100. In this case, the cooling pipe is preferably intensively placed on other outer plates than the outer plate connected to the heat generation elements 103 with low thermal resistance, i.e., the outer plate contacting the pump device 10, among the outer plates of the control device 100, and in this manner, the heat generation elements 103 are efficiently cooled.

(Advantageous Effects of Second Variation)

In the present variation, the liquid cooling type cooling mechanism configured to cool the pump device 10 is provided, and therefore, the effect of cooling the pump device 10 and the ball bearing 8 with higher cooling performance is provided.

Various embodiments and the variations have been described above, but the present invention is not limited to these contents. Moreover, the embodiments and the variations may be applied alone or in combination. Other aspects conceivable within the scope of the technical idea of the present invention are also included in the scope of the present invention.

What is claimed is:

1. A vacuum pump comprising:

a pump device configured to rotate a rotor about a rotation axis supported by a ball bearing, thereby discharging gas sucked through a pump suction port from a pump exhaust port; and a control device attached to a side surface along a direction of the rotation axis of the pump device, including an electronic circuit having a heat generation element and a housing configured to house the electronic circuit, and configured to control operation of the pump device, wherein the heat generation element directly contacts an outer plate of the housing not contacting the pump device, and does not contact an outer plate of the housing contacting the pump device, the housing is a substantially rectangular parallelepiped body having a longitudinal direction along the direction of the rotation axis, and the outer plate of the housing contacting the heat generation element is an outer plate extending along the direction of the rotation axis.

2. The vacuum pump according to claim 1, wherein the housing contacts the pump device via a heat insulating member.

3. The vacuum pump according to claim 1, further comprising:

a cooling fan placed on an outer surface of the pump device and configured to cool the pump device.

4. The vacuum pump according to claim 3, wherein the control device is placed on a cooling path of cooling wind from the cooling fan.

5. The vacuum pump according to claim 3, wherein the cooling fan is placed on a side of the pump device opposite to the control device with respect to the rotation axis.

6. The vacuum pump according to claim 1, wherein the heat generation element is connected to the outer plate of the housing via a heat transfer member.

7. The vacuum pump according to claim 1, wherein a portion of a side surface of the pump device facing the control device is a flat surface, and a clearance between the flat surface and the control device is provided.

8. The vacuum pump according to claim 1, wherein the outer plate of the housing which the heat generation element directly contacts is made of metal.

9. A vacuum pump comprising:

a pump device configured to rotate a rotor about a rotation axis supported by a ball bearing, thereby discharging gas sucked through a pump suction port from a pump exhaust port; and a control device attached to a side surface along a direction of the rotation axis of the pump device, including an electronic circuit having a heat generation element and a housing configured to house the electronic circuit, and configured to control operation of the pump device, wherein the heat generation element directly contacts an outer plate of the housing not contacting the pump device, and does not contact an outer plate of the housing contacting the pump device, and the outer plates are joined with each other via a high thermal resistive seal material.

* * * * *